United States Patent [19]

Larson

[11] 4,332,308

[45] Jun. 1, 1982

[54] SAFETY STEPLADDERS

[75] Inventor: Clayton E. Larson, Brooklyn, N.Y.

[73] Assignee: White Metal Rolling & Stamping Corp., Brooklyn, N.Y.

[21] Appl. No.: 164,294

[22] Filed: Jun. 30, 1980

[51] Int. Cl.[3] ..... E06C 1/16; E06C 7/08

[52] U.S. Cl. ..... 182/120; 182/228; 182/124

[58] Field of Search ..... 182/120, 124, 125, 228

[56] References Cited

U.S. PATENT DOCUMENTS

| | | | |
|---|---|---|---|
| 335,051 | 1/1886 | Ayres | 182/120 |
| 2,804,355 | 8/1957 | Bartley | 182/120 |
| 2,899,011 | 8/1959 | Babits | 182/120 |
| 3,005,513 | 10/1961 | Larson | 182/228 |
| 3,009,535 | 11/1961 | Larson | 182/124 |
| 4,079,814 | 3/1978 | Larson | 182/124 |
| 4,187,928 | 2/1980 | Larson | 182/124 |

*Primary Examiner*—Reinaldo P. Machado
*Attorney, Agent, or Firm*—Carroll F. Palmer

[57] ABSTRACT

Stepladders having flat tread steps have a step extender fixed along the rear edge of the first step from the top of the ladder to increase the width of the step bearing surface and improve ladder safety. The extender comprises a flat tread portion and a depending brace portion. A minor section of a longitudinal edge of the extender overlaps the upper, rear edge of the ladder step which it serves to widen.

9 Claims, 14 Drawing Figures

FIG. 1
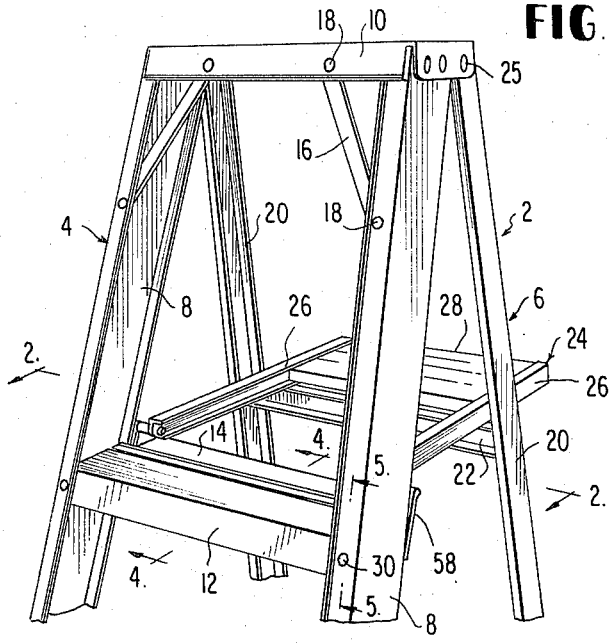
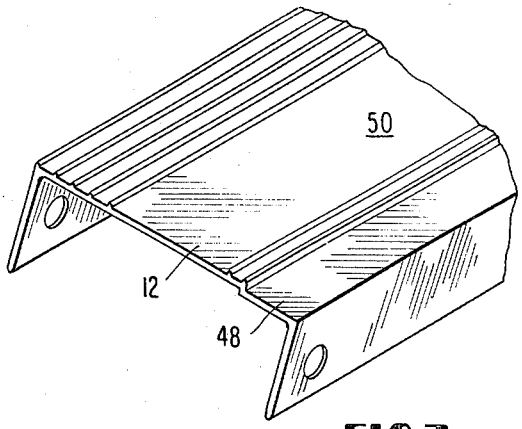
FIG. 7
FIG. 2
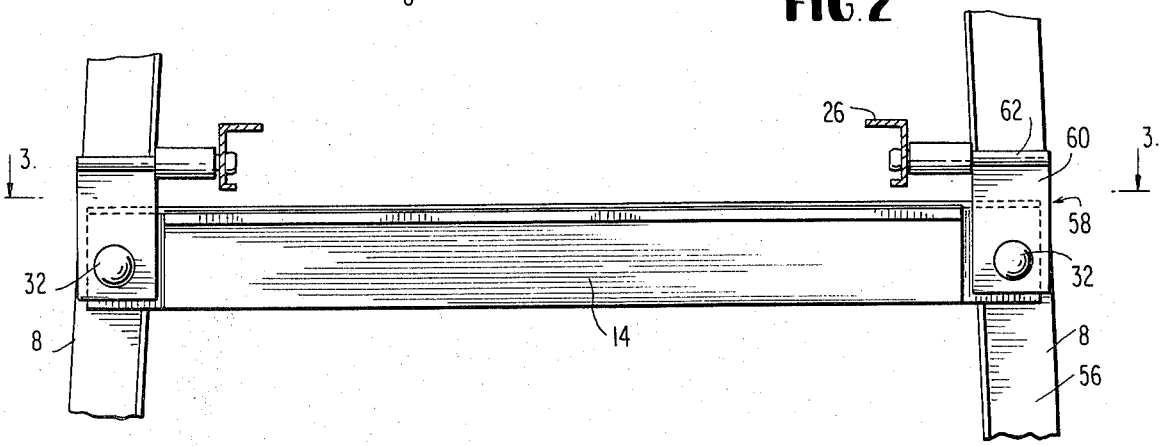
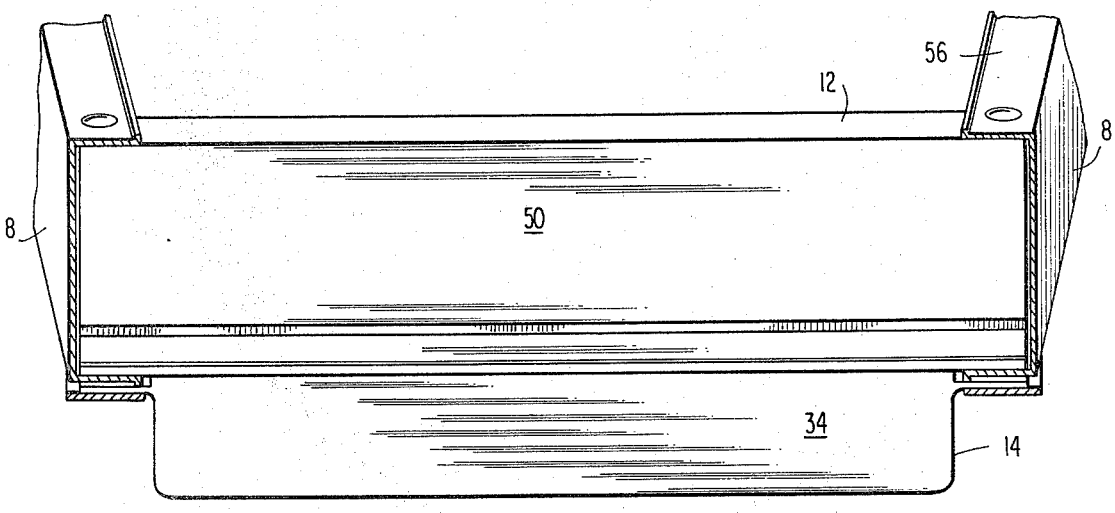
FIG. 3

FIG. 4
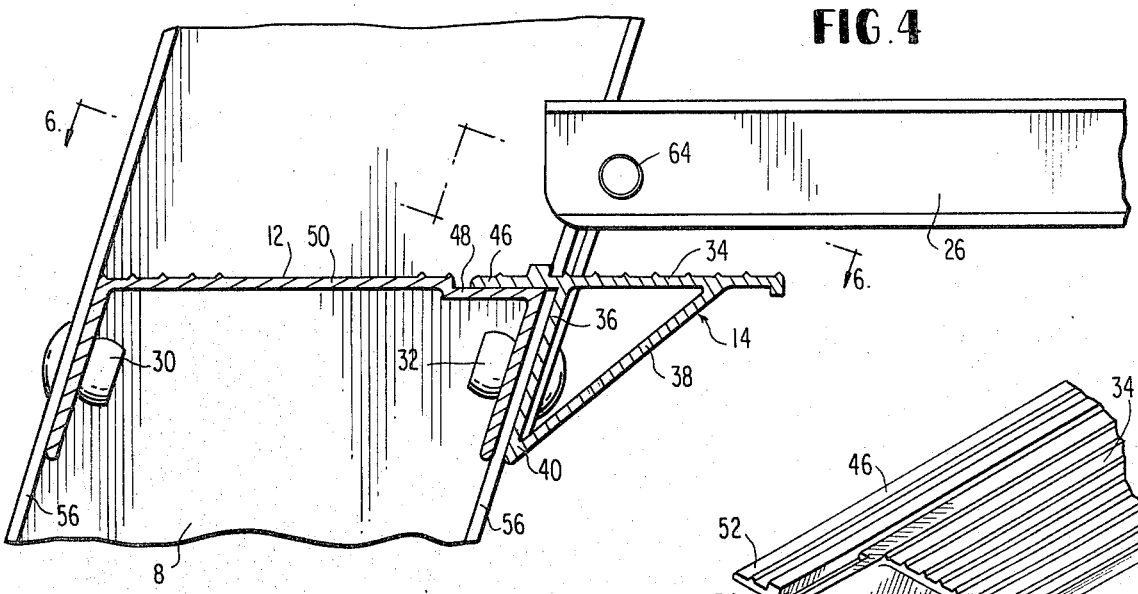
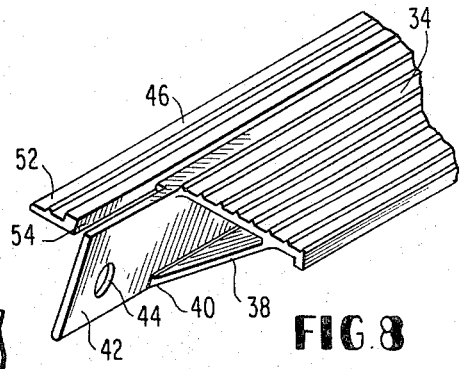
FIG. 8
FIG. 5
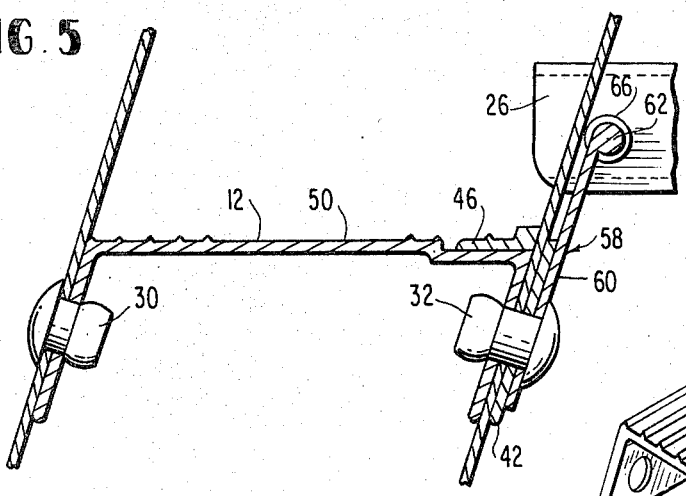
FIG. 9
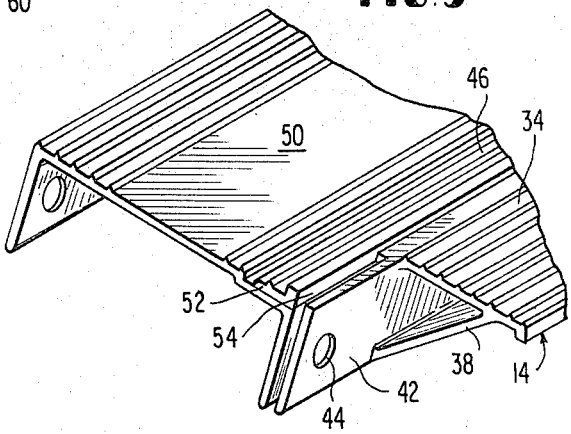
FIG. 6
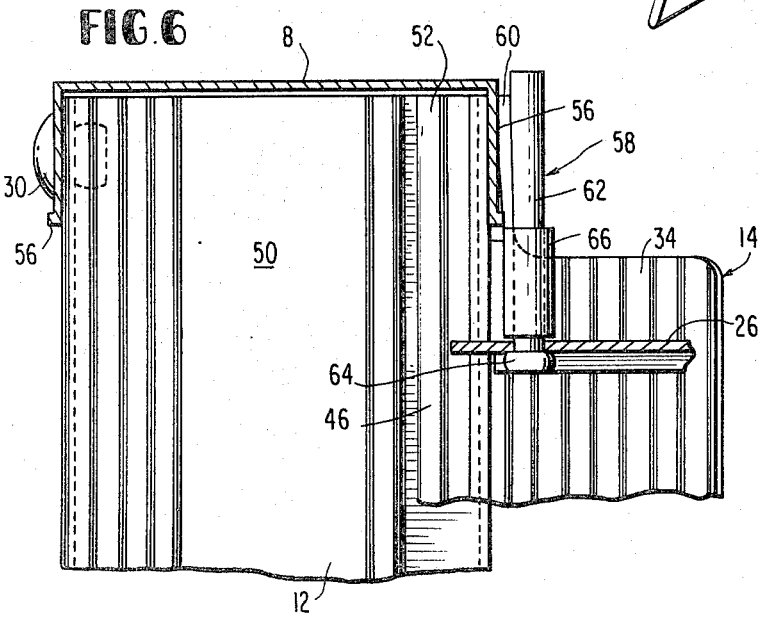
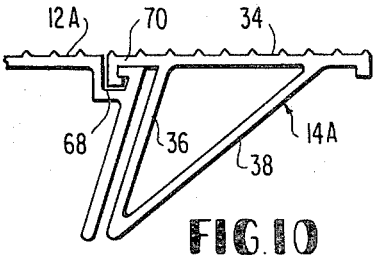
FIG. 10

FIG. 11
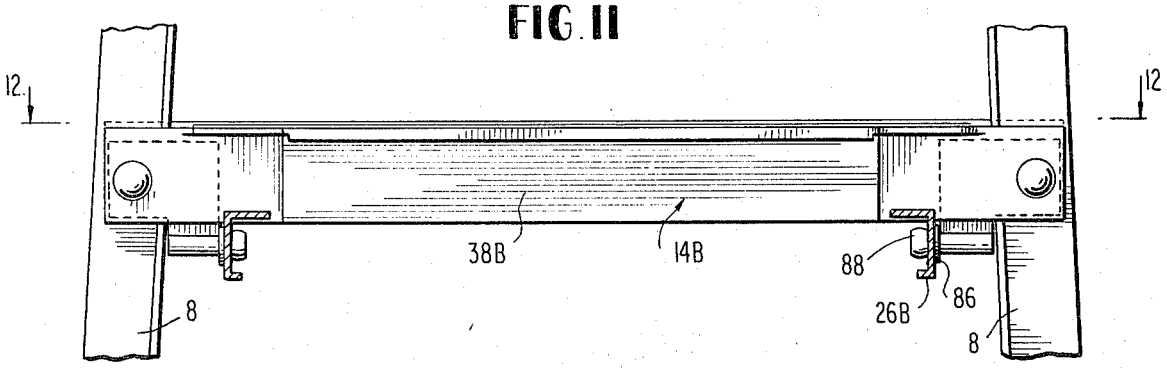
FIG. 12
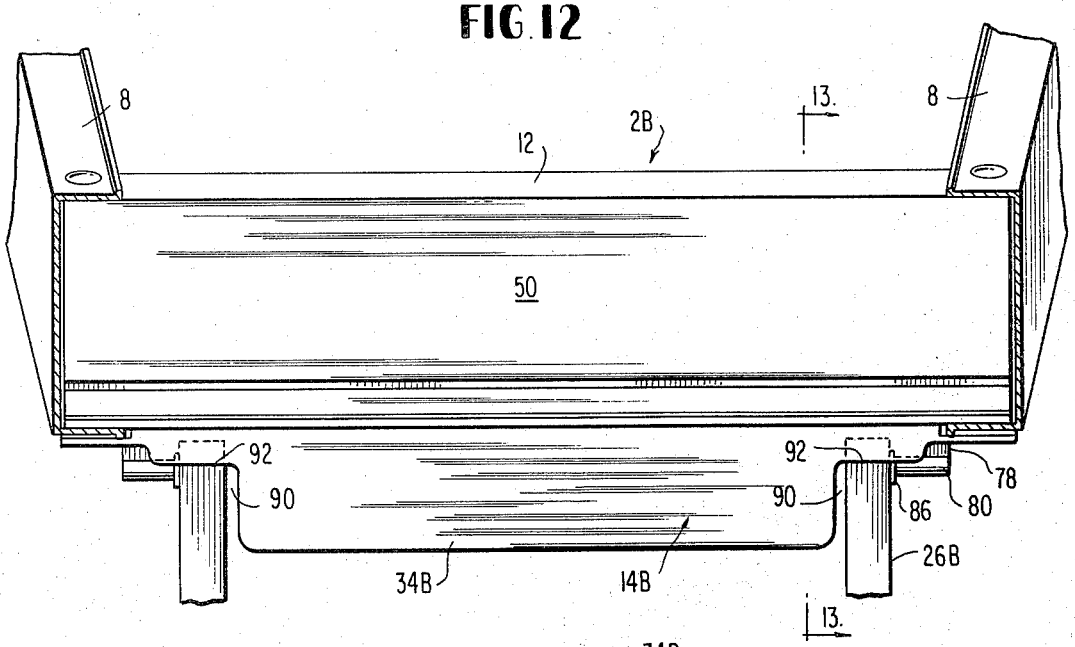
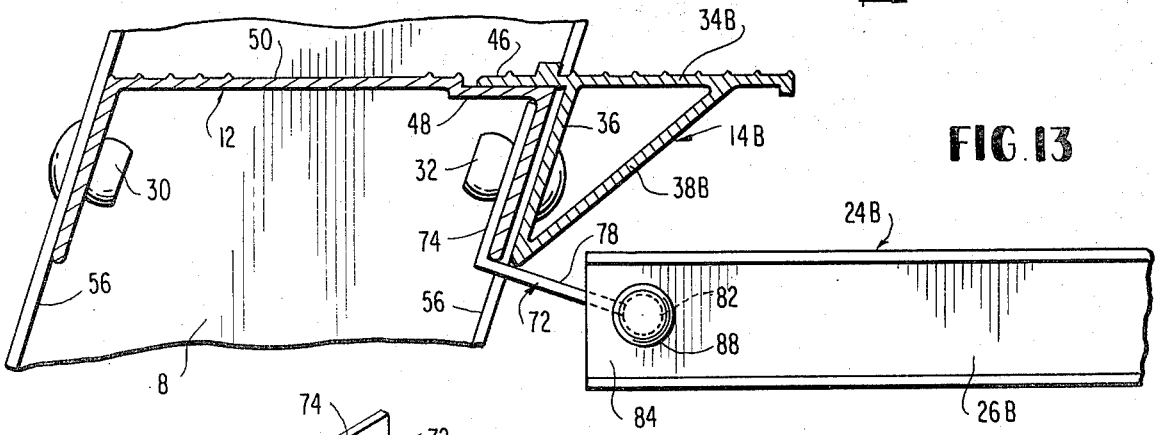
FIG. 13
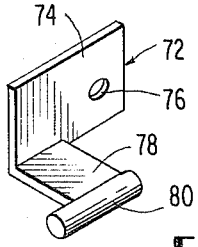
FIG. 14

SAFETY STEPLADDERS

BACKGROUND OF THE INVENTION

1. Field of the Invention

This invention relates to stepladders. More particularly, it concerns flat tread stepladders provided with tread extenders to increase the width of the first step from the top of the ladder and improve ladder safety.

2. Description of the Prior Art

Stepladders if not used properly constitute a safety hazard to homeowners and other users. As a consequence, regulations governing construction of ladders to reduce the opportunity for misuse have been issued by governmental agencies, The American National Standards institute & Underwriters Laboratories.

Persons using stepladders are frequently injured by falling from them because they were standing on the top plate or top step of the ladder. Instructions for use provided with new stepladders warn users against standing on the top plate or top step because this tends to create an unstable condition that can lead to ladder upset and injury. However, instruction for use is not sufficient to reduce this safety hazard. Many users of ladders and other equipment do not bother to read instructions. Hence, another method to mitigate injuries caused by standing on the top plate or top step of a stepladder is to construct the ladder so the user is actively discouraged from using the top plate or top step to stand on and is encouraged to use the next to top step as the maximum standing height. Another way of doing this is to widen the distance between the top plate step and the first step from the top, e.g., spacing these two members 18 inches apart. This spacing makes it difficult for the ladder user to step up onto the top plate, thereby discouraging its use to stand upon and the lower location of the top step greatly improve ladder stability in its use. However, this wider spacing creates an additional hazard. Thus, the leg of the user is not blocked by the top plate in forward movement as much as on lower steps that are more closely spaced. Consequently, it is possible for the user's foot to extend inwardly beyond the rear edge of the top step when that step has the 18 inch spacing. This permits the user to fall inward across that step.

The normal stepladder construction involves steps positioned, starting approximately twelve inches (12") from the floor and in one foot (1') intervals, to a point approximately twelve inches (12") below the stepladder top plate. However, new labeling and code requirements necessitate the placing of labels on both the top plate and top step, prohibiting their use in climbing the ladder. The maximum climbable height therefore, becomes two feet (2') less than the total height of the ladder.

In the alternate construction, the positioning of the top step eighteen inches (18") below the top plate, with the bottom step six inches (6") from the floor was allowed, together with permission for standing on the top step in this case. However, a provision is made in both codes requiring that a bar or other suitable barrier be placed across the back of the front section, between the top step and the top plate, which would prevent the user from stepping inward and consequently falling into the ladder. Quite obviously, this bar or barrier would have to be made in a manner that would prevent standing on it or of sufficient strength so that it would not bend if a careless climber did apply his weight.

An alternate provision is allowed in which a trend extension, to a point coincident with a vertical line from the leading edge of the top plate, would fit the requirement. With the top step so widened, the top plate will be able to stop the user's leg before his foot passes beyond the back edge of the top step. This invention concerns improvements in stepladders with the safety feature of a wide spaced top step combined with extra width for the step to mitigate the step-through hazard.

Of course, there are a variety of ways in which one or more steps of a stepladder may be widened. However, many of these would lead to substantially higher manufacturing costs because of increase in required number of parts, complications in ladder fabrication, etc. Hence, there exists a need in the ladder trade for a way to effectively widen the tread of steps of stepladders while maintaining good strength qualities with low manufacturing costs and also obtaining improved safety features. The present invention concerns a tread extender that not only provides the necessary extension for the safety requirement, but also involves an innovative and unique answer to the indicated existing need.

A further aspect of this invention involves the mounting of bucket rack brackets to the same common rivet of a type similar to those utilized in U.S. Pat. No. 4,187,928 and the utilization of a bucket rack unfolding from these brackets toward the rear section and resting on a rear crossbrace, which in turn achieves the same total number of rivets in the ladder.

The new ladder manufacture regulations require that means be provided for preventing the bucket rack angles or channels from projecting through the front section of a stepladder when the ladder is being folded, avoiding hitting the user in the face or body. By the arrangement provided by the present invention, this requirement is satisfied.

OBJECTS

A principal object of this invention is the provision of new improvements in stepladders. Further objects include the provision of stepladders that:

(1) Have a wider tread in the first step from the top plate of the ladder than in the lower steps to provide an improved stepping surface, increasing the climber's stability and safety when using such highest permitted step on the ladder.

(2) Include a step extender for the top step that will withhold the full test load required for the step without bending.

(3) Are light in weight, but have good strength, rigidity, stability and safety properties.

(4) Include a step extender that will not require any more rivets for assembly with the extender than without it.

(5) Include a ladder step and step tread extender combination capable of sustaining the torsional effect placed upon the combination under the full test load required for the step.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished according to the present invention by providing at least the top step of a stepladder with a tread extender. Basically, such tread extender comprises a flat tread portion, mounting lugs at each side and a depending truss member.

Preferably, the truss member comprises a first web depending integrally from the tread portion and a second integral, depending web angled toward the first web and joined to the first web at their point of intersection.

A minor section of the extender tread portion overlaps the upper rear edge of the step it serves to extend and the step is contoured to receive the overlap so the tread surface is entirely flat. Tongue and groove or similar structure can be used to interlock the step and extender.

Advantageously, the mounting lugs are an extension of the first web of the truss member and the extender is fixed to the ladder siderails by the same rivets used to fasten the rear of the step to the ladder.

BRIEF DESCRIPTION OF THE DRAWINGS

A more complete understanding of the invention may be obtained by reference to the accompanying drawings in which:

FIG. 1 is a fragmentary, perspective view of the top portion of a stepladder constructed in accordance with the invention.

FIG. 2 is a fragmentary, sectional view taken on the line 2—2 of FIG. 1.

FIG. 3 is a fragmentary, sectional view taken on the line 3—3 of FIG. 2.

FIG. 4 is a fragmentary, sectional view taken on the line 4—4 of FIG. 1.

FIG. 5 is a fragmentary, sectional view taken on the line 5—5 of FIG. 1.

FIG. 6 is a fragmentary, sectional view taken on the line 6—6 of FIG. 4.

FIG. 7 is a fragmentary, isometric view of the end portion of a new ladder step of the invention.

FIG. 8 is a fragmentary, isometric end view of a step extender of the invention.

FIG. 9 is a fragmentary, isometric end view of the step of FIG. 7 combined with the extender of FIG. 8.

FIG. 10 is a fragmentary, lateral view of another form of step and step extender combination of the invention.

FIG. 11 is a fragmentary, lateral view of yet another form of step extender and bucket rack support combination of this invention.

FIG. 12 is a fragmentary, sectional view taken on the line 12—12 of FIG. 11.

FIG. 13 is a fragmentary, sectional view taken on the line 13—13 of FIG. 12.

FIG. 14 is an isometric view of a bucket rack bracket of the invention.

DESCRIPTION OF PREFERRED EMBODIMENTS

Referring in detail to the drawings, the stepladder 2 comprises a front step section 4 and a rear prop section 6. The section 4 comprises a pair of side rails 8, a top plate 10, a top step 12 with step extender 14 and brace strips 16 fixed between top plate 10 and side rails 8 by rivets 18.

The prop section 6 comprises side rails 20 and cross brace 22 which serves not only as an essential part of the prop section 6, but also as a support for the bucket rack 24 when it is in the lowered position. The prop section is pivoted on the top plate 10 by rivets 25.

The bucket rack 24 comprises a pair of side channels 26 and platform members 28.

The step 12 is fixed by rivets 30 and 32 on the side rails 8 about 18 inches from the top plate 10. The remaining steps on the ladder (not shown) are spaced about 12 inches apart.

The step extender 14 comprises a flat tread portion 34, a first web member 36 depending integrally from the tread portion 34 and a second web member 38 depending integrally from the tread portion 34 at an acute angle to the web member 36. The members 36 and 38 are joined together at their point of intersection 40. An integral lug 42 extends laterally from each end of the web member 36 and each lug 42 has a hole 44 therethrough. A minor front section 46 of the extender 14 overlaps the upper rear edge 48 of the step 12. The rear edge 48 is offset from the rest of the tread portion 50 of the step 12 so that the tread portion 34 of extender 14 and tread portion 50 of step 12 are coplanar.

The front section 46 of extender 14 extends at each side 52 beyond the tread portion 34 a distance equal to the lugs 42 and there is a slot 54 between the side extensions 52 and the lugs 42 having a width equal to the lateral elements 56 of side rails 8. As shown in FIG. 4, the lateral elements 56 extend into the slot 54 and rivets 32 pass through the holes 44 of lugs 42 so the rivets 32 fix both the step 21 and extender 14 to the side rails 8.

The rivets 32 also fix the bucket rack bracket 58 to the side rails 8. The bracket 58 is formed from a section of extruded aluminum alloy or other metal with a web section 60 and an integral rod portion 62. A portion of the web section 60 (see FIG. 2) is cut away so that the rod portion 62 extends inwardly beyond the web section 60 and passes through a hole in a side channel 26 of the bucket rack 24. The tip 64 of the rod portion 62 is peened to hold the side channel 26 on the bracket 58. Hence, the bucket rack 24 may pivot on the bracket 58 between a lowered position as shown in FIG. 1 and a raised position. The bucket rack 24 is prevented from passing through the front section 4 of ladder 2 by the brace strips 16.

The ladder 2 tapers down in width from bottom to top so the side rails 8 are closer together at the top plate 10 than at the step 12. Hence, the bucket rack 24 is narrower than the step 12 so that it may fit between the side rails 8 in the raised position. In order to keep the bucket rack 24 centered between the side rails 8, short sections of metal tubing 66 are fitted over the rod portion 62 extending between the side channels 26 and the lateral members 56 of side rails 8.

In the modified form of step extender 14A shown in FIG. 10, the step 12A has a longitudinal cavity 68 in its rear edge to receive the hooked front edge 70 of step extender 14A providing a tongue and groove connection between the step 12A and extender 14A.

Stepladders constructed in accordance with the invention provide the safety features required by current manufacturing regulations. Thus, the step 12 is spaced apart from the top plate 10 a distance sufficient to discourage use of the top plate as a step. Also, the step extenders 14 or 14A widen the tread area of steps 12 or 12A sufficiently to prevent users of the ladder from "stepping through" the ladder. The step extenders of the invention are structured so they are capable of supporting the full load that will be applied to the tread area of the step and extender during use of the ladder. All of this is attained without need to use any more rivets for assembly of the ladders than would be required if the ladders were made without the step extender.

In the modification of the invention shown in FIGS. 11–13, the step extender 14B comprises flat tread portion 34B, first web member 36 and second web member 38B.

The bucket rack brackets 72 for this modification of the new stepladders comprise a web 74 having a hole 76 therein, a lateral arm 78 and a rod portion 80. The brackets 72 are fixed upon the ladder 2B by rivets 32 that extend through the bracket holes 76. The side channels 26B of the bucket rack 24B have holes 82 in their ends 84 and the rod portions 80 of the brackets 72 extend through such holes. Washers 86 are positioned between the side channels 26B and lateral arms 78. The inner ends 88 of the rod portions 80 are peened to retain the side channels 26B on the brackets 72.

The tread portion 34B of step extender 14B has notches 90 at each side to permit the bucket rack 24B to be raised to a vertical position when the ladder 2B is folded up for storage transport etc. The ledges 92 provided at the rear of the side notches 90 engage the side channels 26B of the bucket rack 24B to limit the forward movement of the bucket rack 24B when it is raised. Hence, this arrangement fulfills the code requirements for preventing the bucket rack from falling through the front of the ladder and hitting the face or body of the ladder user.

CONCLUSION

The improved safety stepladders of the invention fully comply with existing safety code requirements. They comprise a top step that is as close to the top plate as permitted and a step extender of unique construction that serves to prevent the ladder user from stepping beyond the top step into the ladder. All of this is attained using a minimum amount of construction materials because of the way in which the step extender, side rails and bucket rack supports are combined.

The embodiments of the invention in which an exclusive property or privilege is claimed are defined as follows:

1. In a ladder of the pivoted prop type comprising a front step section having a pair of side rails and a plurality of flat tread steps carried by said side rails, the improvement of a step extender that comprises:

a flat tread portion, a first web member depending integrally from said tread portion, a second web member depending integrally from said tread portion at an acute angle to said first web portion, said first and second web portions being joined together at their point of intersection, an integral lug extending laterally from each end of said first web member, each lug having a hole there through, a minor section of said tread portion overlapping the upper, rear edge of one of the steps of said ladder, said step extender being fixed to said ladder side rails by having the rivets that hold said one of the steps upon the ladder side rails pass through said holes in said lugs.

2. The ladder of claim 1 wherein said one of the steps is the top step of the ladder.

3. The ladder of claim 2 wherein said top step has a recess in its tread portion along the rear edge thereof to receive said minor section of said step extender whereby the exposed surfaces of said top step and said step extender lie in the same plane.

4. The ladder of claim 3 wherein said minor section of said step extender has a hooked longitudinal edge and said top step has a longitudinal cavity to receive said hooked edge.

5. In a ladder of the pivoted prop type comprising a front step section having a pair of side rails and a plurality of flat tread steps carried by said side rails, the improvement of a step extender to increase the width of the step bearing surface, said extender comprising:

a flat tread portion, a brace portion depending integrally from said tread portion, lugs extending from the ends of said brace portion, a minor section of said tread portion overlapping the upper, rear edge of a step of said ladder, and fasteners extending through said lugs to fix said extender to the side rails of said ladder.

6. The ladder of claim 5 having a bucket rack pivoted upon brackets that are fixed to the ladder by said fasteners that fix said extender to said side rails.

7. The ladder of claim 6 wherein said fasteners are rivets.

8. The ladder of claim 6 wherein said brackets comprise a web portion through which said fasteners extend, a lateral arm and a rod portion that extends through a hole in a side channel of said bucket rack.

9. The ladder of claim 6 wherein the prop section of the ladder comprises a cross-member upon which the bucket rack rests when it is in its lowered position.

* * * * *